US007547131B2

(12) United States Patent
Faunce

(10) Patent No.: US 7,547,131 B2
(45) **Date of Patent: *Jun. 16, 2009**

(54) ILLUMINATED ELECTRICAL BOX COVER PLATE

(76) Inventor: Michael Joseph Faunce, 11885 SW. Bull Mountain, Tigard, OR (US) 97224

( * ) Notice: Subject to any disclaimer, the term of this patent is extended or adjusted under 35 U.S.C. 154(b) by 0 days.

This patent is subject to a terminal disclaimer.

(21) Appl. No.: 11/657,436

(22) Filed: Jan. 23, 2007

(65) Prior Publication Data

US 2007/0127241 A1 Jun. 7, 2007

Related U.S. Application Data

(63) Continuation-in-part of application No. 11/497,773, filed on Aug. 2, 2006.

(60) Provisional application No. 60/706,868, filed on Aug. 10, 2005.

(51) Int. Cl.
*H01R 33/00* (2006.01)

(52) U.S. Cl. ..... 362/641; 362/95; 362/209; 362/640; 362/642; 362/643; 362/644; 362/800

(58) Field of Classification Search ..... None
See application file for complete search history.

(56) References Cited

U.S. PATENT DOCUMENTS

| | | | | | |
|---|---|---|---|---|---|
| 4,508,943 | A * | 4/1985 | Pfeiffer et al. | ..... | 200/17 R |
| 4,755,913 | A * | 7/1988 | Sleveland | ..... | 362/95 |
| 4,835,343 | A * | 5/1989 | Graef et al. | ..... | 174/66 |
| 4,873,469 | A * | 10/1989 | Young et al. | ..... | 315/155 |
| 5,485,356 | A * | 1/1996 | Nguyen | ..... | 362/95 |
| 5,660,459 | A * | 8/1997 | Appelberg | ..... | 362/84 |
| 5,670,776 | A * | 9/1997 | Rothbaum | ..... | 250/214 AL |
| 5,833,350 | A * | 11/1998 | Moreland | ..... | 362/95 |
| 6,423,900 | B1 * | 7/2002 | Soules | ..... | 174/66 |

* cited by examiner

*Primary Examiner*—Sandra L O'Shea
*Assistant Examiner*—Danielle Allen
(74) *Attorney, Agent, or Firm*—Mark S. Hubert

(57) ABSTRACT

The present invention is a low power and low heat dissipating, low illumination system that is based in an electrical box cover plate, preferably in a light switch cover plate. It allows for the maintenance of an electrical bleed current through the fluorescent light controlled by that light switch so as to keep a minimal thermal differential between the unlit and lit light. The light switch cover plate has a series of imbedded LEDs that illuminate an area all around the light switch. The unit is retrofittable on conventional light switches.

18 Claims, 7 Drawing Sheets

ILLUMINATED ELECTRICAL BOX COVER PLATE

This is a continuation in part of non provisional Utility patent application Ser. No. 11/497,773 filed Aug. 2, 2006 claiming priority from U.S. Provisional patent application Ser. No. 60/706,868 filed Aug. 10, 2005.

BACKGROUND OF THE INVENTION

The present invention relates to a low level illumination system, and, more particularly, to an illuminated cover plate for an electrical outlet or electrical switch. It is adapted to provide safety, energy savings and enhance florescent light longevity.

The majority of residential, commercial and industrial buildings do not have an adequate low level illumination system to allow the safe and comfortable actions of people when the main light source is turned off. While this may be partially overcome by the installation of portable night lights into an electrical outlet, therein lies one problem. Illumination is needed at light switch and electrical controls, near doors and above counter tops. Many homes/hotels do not have night light outlets at these locations but do have wall switches where the illumination is most needed.

Since most night lights do not provide sufficient lighting in an area to adequately address the problem, it is common for people to leave on the bathroom light throughout the entire night. There is a higher incidence of this by hotel patrons because of the unfamiliarity with the room. As such hotels have unnecessarily high power consumption. Research in the United States has shown that, with standard occupancy rates, approximately $30 per year per hotel room can be saved if the bathroom light can remain off at night.

Other problems such as night light burnout, theft, breakage, heat, dimness and moderate power consumption are inherent with the use of conventional portable night lights. These problems may be eliminated or significantly reduced by the use of an LED illuminated electrical box cover switch.

A related problem is that most hotel rooms replace fluorescent lights at a higher than average rate. Commonly, the heat is lowered substantially in unused hotel rooms which keeps the fluorescent fixtures at a reduced temperature. When the fluorescent light is switched on, the end cap electrodes rapidly become warm. This broad thermal change causes micro fractures in the end cap and at the glass/electrode interface. This leads to the premature loss of gas from the light and early bulb failure. This can be minimized by providing a small bleed current of electricity through the fluorescent tube when the light is off, to keep the tube in a warmer state or pre-start readiness.

Henceforth, an improved illuminated electrical box cover plate that allows a bypass bleed current to preheat any florescent lights fed from that circuit would fulfill a long felt need in the industry. This new invention utilizes and combines known and new technologies in a unique and novel configuration to overcome the aforementioned problems and accomplish this.

SUMMARY OF THE INVENTION

The general purpose of the present invention, which will be described subsequently in greater detail, is to provide an improved low level illuminating system based on an light emitting diode (LED) electrical box cover plate that is able to preheat fluorescent lights if the electrical box controls one such light. It has many of the advantages mentioned heretofore and many novel features that result in a new low level illumination system which is not anticipated, rendered obvious, suggested, or even implied by any of the prior art, either alone or in any combination thereof.

In accordance with the invention, an object of the present invention is to provide an improved LED illuminated light switch cover plate capable of a low heat, low power consumption operation suitable for assisted living conditions.

It is another object of this invention to provide an improved LED illuminated light switch cover plate capable of preheating any fluorescent lights operated by the light switch.

It is a further object of this invention to provide a LED illuminated light switch cover plate that offers a broadly disbursed soft light capable of illuminating the general vicinity of the cover plate.

It is still a further object of this invention to provide for a safe LED illuminated electrical box cover plate that uses a minimal power consumption and is retrofittable with existing wall cover plates.

It is yet a further object of this invention to provide a LED illuminated, low power consumption, shock resistant, electro static discharge protected electrical outlet cover plate.

In view of the foregoing disadvantages inherent in the prior arts, the general purpose of the present invention is to provide a low level illumination system, ideally for night lighting in residential and commercial applications, configured to include all the advantages of the prior arts, and to overcome the drawbacks of the prior arts.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

DETAILED DESCRIPTION

Figure 1:
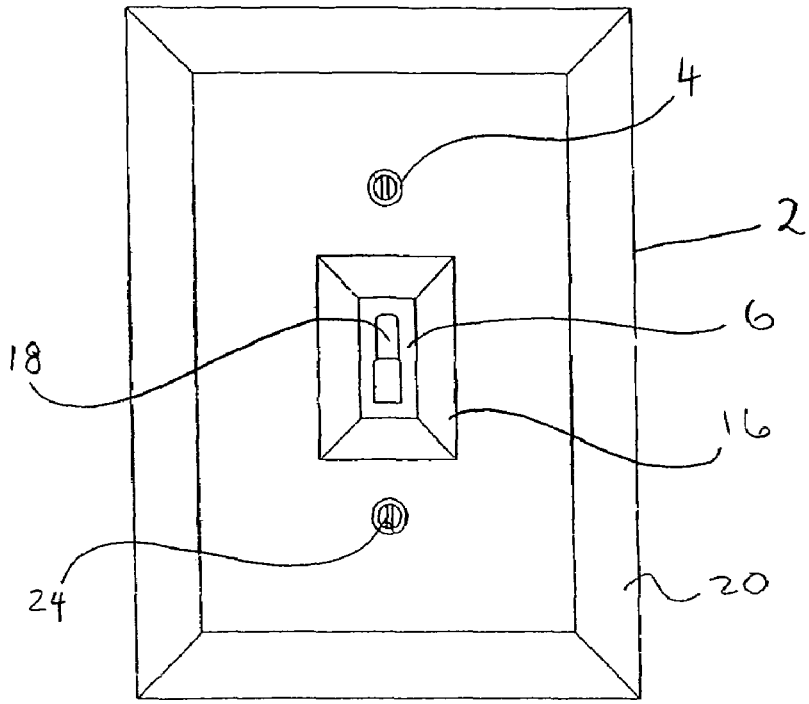
FIG. 1 is a front view of the illuminated electrical switch cover plate.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

In the following detailed description, reference is made to the accompanying drawings which form a part hereof wherein like numerals designate like parts throughout, and in which is shown by way of illustration specific embodiments in which the invention may be practiced. It is to be understood that other embodiments may be utilized and structural or logical changes may be made without departing from the scope of the present invention. Therefore, the following detailed description is not to be taken in a limiting sense, and the scope of the present invention is defined by the appended claims and their equivalents.

Figure 2:
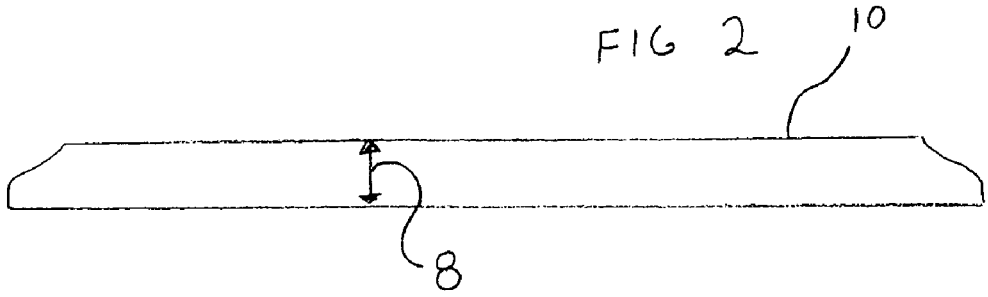
FIG. 2 is a side view of the illuminated electrical switch cover plate.
Figure 3:
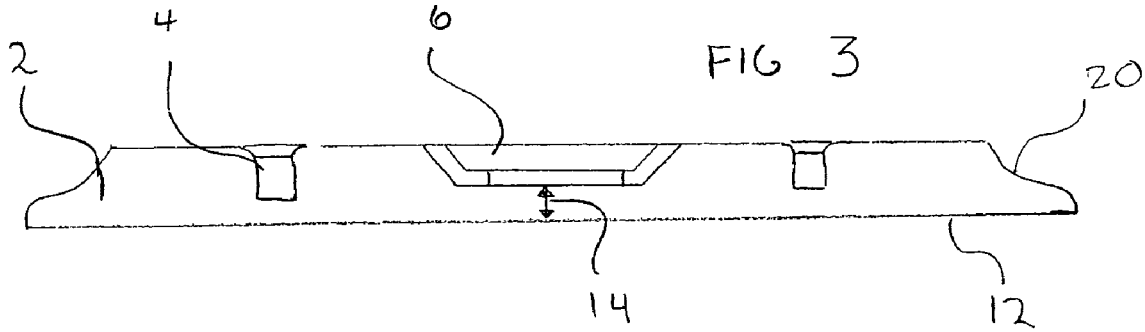
FIG. 3 is a side cross sectional view of the illuminated electrical switch cover plate.

Looking at FIGS. 1, 2 and 3 the physical configuration of the illuminated electrical switch cover plate 2 can best be seen. The cover plate 2 is of a generally planar, right rectangular configuration, the critical dimensions of which are well known in the art so as to conform to the sizes of conventional or approved electrical boxes for installation adjacent light switches or electrical outlets. In a similar manner, the location of the switch orifice 6 and the mounting fastener guides 4 are aligned so as to matingly conform to the configuration of light switches and electrical outlets.

The thickness of the cover plate 2 denoted by dimensional arrow 8 is greater than that of it's conventional non illuminated counterpart because the cover plate 2 must house a printed circuit board (PCB). In order to facilitate installation of the cover plate 2 over a light switch 18 without having to outwardly shim the light switch 18 to mate with the top surface 10, the switch orifice 6 is depressed with respect to the top surface 10 cover plate 2. In this manner, the distance between the switch orifice 6 and the electrical box denoted by dimensional arrow 14 is substantially similar to that of it's conventional non illuminated counterpart. For aesthetic purposes the cover plate has a sloping exterior periphery 20 and a sloping interior periphery 16 about the switch orifice 6.

Figure 4:
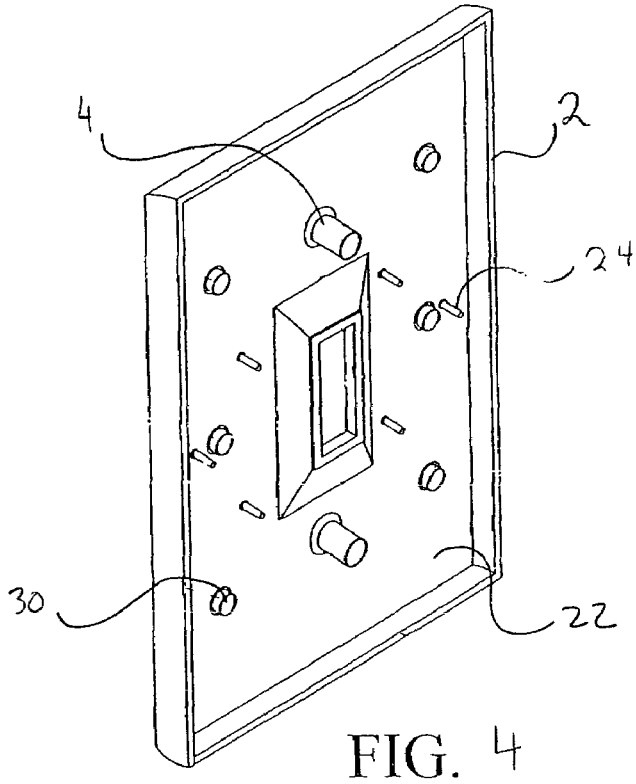
FIG. 4 is a rear perspective view of the illuminated electrical switch cover plate.
Figure 5:
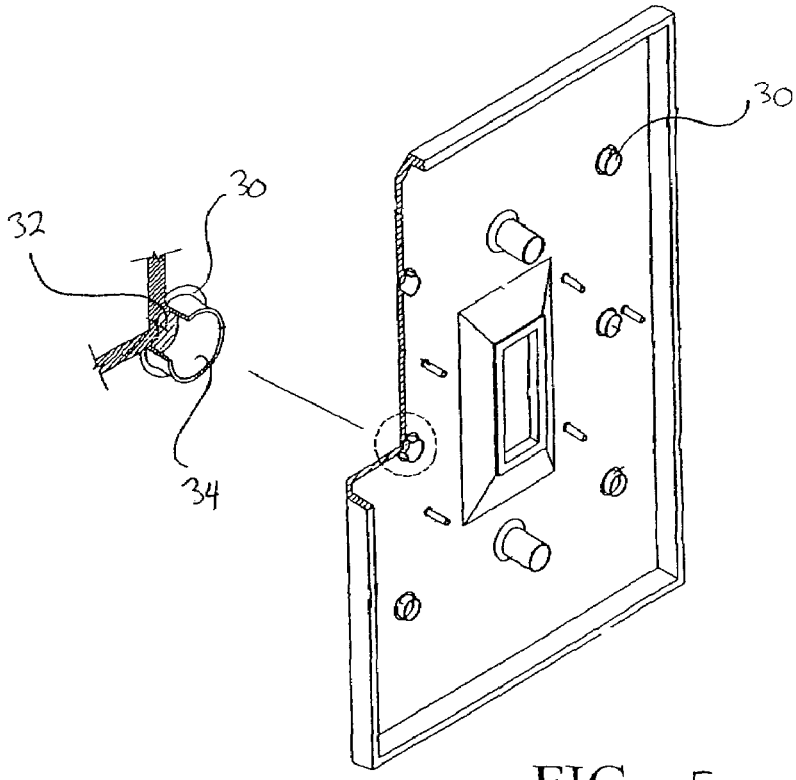
FIG. 5 is a sectional rear perspective view of the illuminated electrical switch cover plate.
Figure 7:
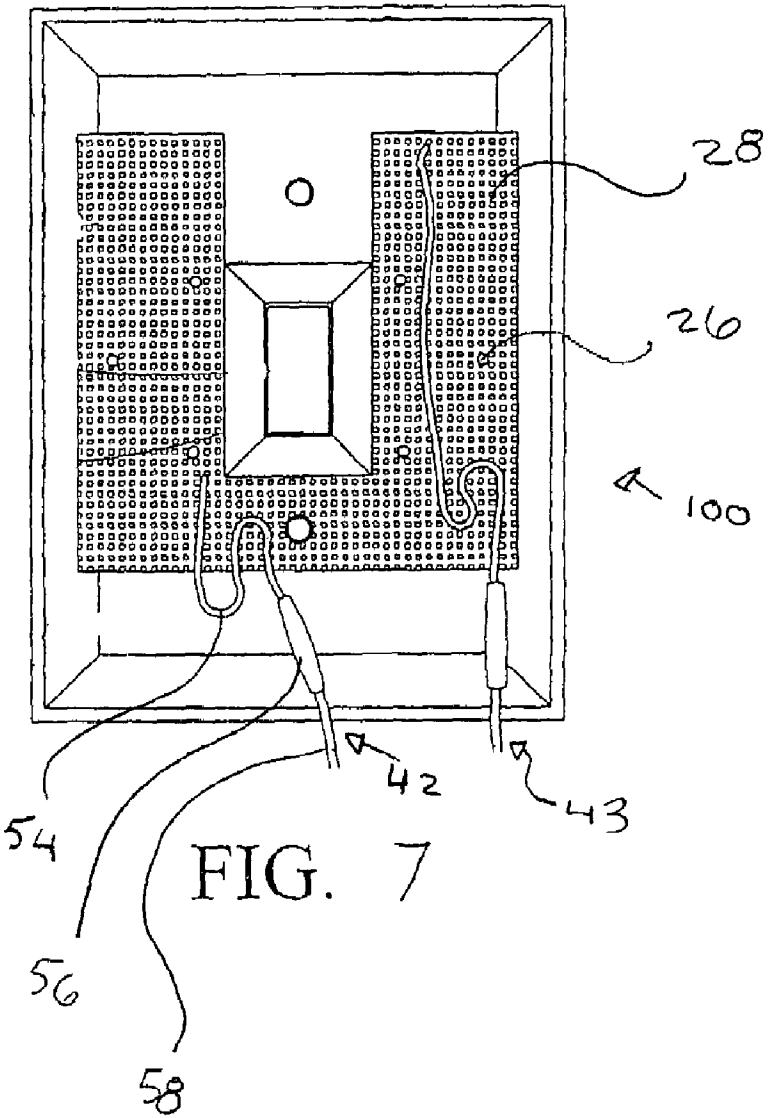
FIG. 7 is a rear perspective view of the illuminated electrical switch cover plate with the printed circuit board installed.

Looking at FIGS. 4 and 5, the details of construction of the rear of the switch cover 2 can best be seen. Mounting fastener guides 4 extend normally from the back surface of the cover plate 22 so as to receive and direct the mechanical fasteners 24 that secure the cover plate to the light switch 18. A plurality of posts 24 extend normally from the back surface and are adapted to be received in locating orifices 26 of the PCB 28 (FIG. 7). A plurality of diffusers 30 are equally spaced about the cover plate. The diffusers 30 are right cylinders 34 having an open proximate end and a closed distal end or lens 32, that extend normally from the cover plate 2. The cylinder is sized to receive a conventional LED therein the proximate end.

Figure 6:
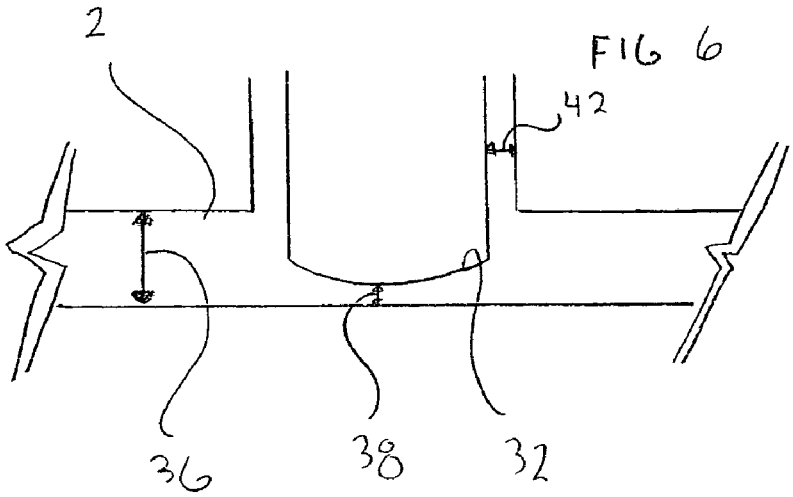
FIG. 6 is a side cross sectional view of the diffuser lens.

Looking at FIG. 6, a cross sectional side view of the diffuser 30 it can be seen that the thickness of the cover plate 2 generally, denoted by dimensional arrow 36 is greater than the thickness of the right cylinder 34 as denoted by dimensional arrow 40, which is greater than the thickness of the lens 32 of the diffuser 30, denoted by dimensional arrow 38. In the preferred embodiment the lens thickness is 0.025-0.030 of an inch. The lens 32 in the preferred embodiment has a concave "domed" profile for better light dispersion however it is well known that the profile of the lens 32 may be flat, convex or irregular depending upon the visual effect desired.

FIG. 7 illustrates the PCB 28 as affixed to the back surface 22 of the cover plate 2 to form the illuminated electrical switch cover plate system 100. The PCB 28 is U shaped so as to be disposed about three sides of the switch orifice 6. Posts 24 are received into locating orifices 26 of the PBC 28 to as to ensure that the LED's 48 on the PBC 28 are physically positioned to reside within the proximate end of the diffuser 30. In fabrication, the posts 24, once inserted through the locating orifices 26, are thermally fused to the back side of the PCB 28 in a process known as heat staking. The assembled unit of the cover plate 2 and the PCB 28 is referred to as the illuminated electrical switch cover plate system 100. The front side of the PCB has LED's, resistors, and capacitors connected by trace surface wiring as will be explained in detail with reference to FIG. 8. First wire 42 and second wire 43 are electrically connected to the PCB so as to establish electrical continuity with the trace surface wiring and the resistors, LEDs, capacitors and diodes that make up the circuit. The first wire 42 and second wire 43, extend from the rear of the PCB for parallel electrical connection to the light switch circuit.

Figure 8:
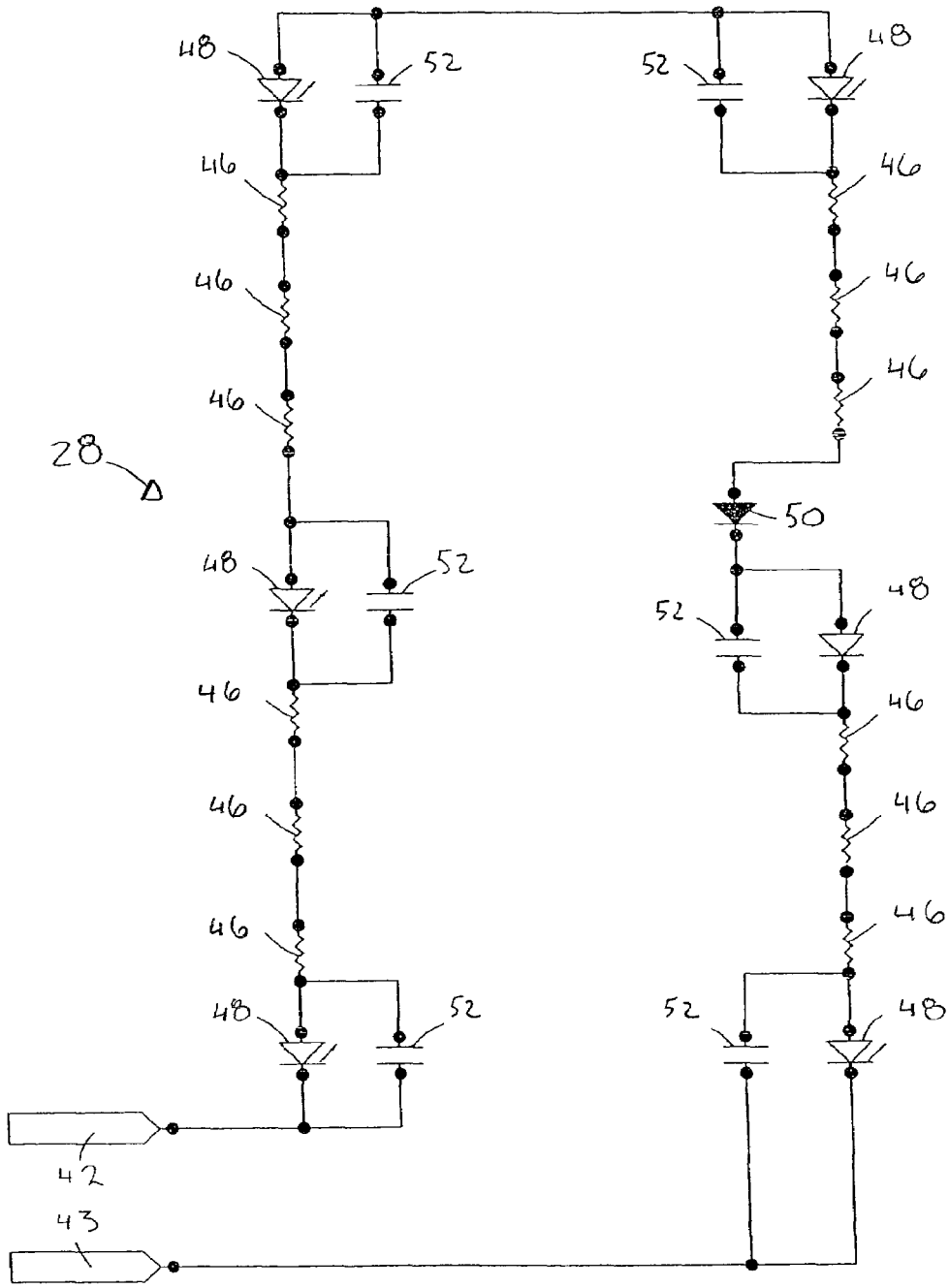
FIG. 8 is an electrical schematic of the printed circuit board for the illuminated electrical switch cover plate.

FIG. 8 illustrates an electrical schematic of the front side of the PCB 28. The preferred embodiment as illustrated has a one watt power profile. This one watt profile has been experimentally developed for safe and comfortable dissipation of heat and has shown to provide the necessary level of illumination. The voltage drop across each LED is determined by the color and fabrication but ranges generally between 1.8 and 3.3 volts having a current of approximately 8 ma passed through it. Each LED wattage is 48. The total circuit resistance is 7440 ohms with a maximum wattage of 1.056 watts ±10%. Each resistor wattage is 48 mw and the resistor is 1206 SMT rated min 0.125 watts. The PCB 28 comprises six LEDs 48 connected in series with twelve resistors 46. Also, an additional diode 50 (1 amp, 400 volt) is present. The PCB 28 has been designed to meet a heat design goal of less than or equal to about 1 watt per six square inches of PCB 28. The PCB 28 has a plurality of resistors 46 for dissipating heat generated in the PCB 28 therein reducing localized hotspots and removing heat evenly from the PCB 28. Additionally, the PCB 28 has a capacitor 52 placed in parallel across each LED 48 for the purpose of for protecting the LED 48 from an electro static discharge (ESD) from an internal and/or an external source and from inductive load counter electromotive forces. This also minimizes the shock hazard to users. The capacitors have a capacitance of about 0.01 μf to about 0.22 μf. (Preferably 0.1 μf) The PCB 28 has a 1 watt power profile with an average current of 7-8 ma and an instantaneous peak current of 20 ma. This ensures that the heat dissipation will be adequate to prevent damage to the PCB 28 or distortion to the cover plate 2.

The first wire 42 and second wire 43 connect the illuminated electrical switch cover plate system 100 to the AC circuit that feeds the light switch 18 such that the illuminated electrical switch cover plate system 100 is in parallel with the switch 18. The illuminated electrical switch cover plate system 100 (i.e., the cover plate 2 and the PCB 28 assembly) may be designed to meet the requirements of electric equipment regulatory authorities (UL and CSA). The illuminated electrical switch cover plate system 100 uses fire rated materials for construction. Also, the design provides adequate intrusion protection to minimize shock hazards. As discussed above, the heat design of the illuminated electrical switch cover plate system 100 is such that, safe operating temperatures are maintained. To meet the UL requirements, the first wire 42 and second wire 43 may be made of 12 or 14 gauge solid copper wire. For practical purposes the preferred embodiment would use 14 gauge wire as this is compatible with the push pop-in connectors found of conventional electrical light switches.

The first wire 42 and second wire 43 that connect the illuminated electrical switch cover plate system 100 to the AC switch may be positioned to allow either for a: two wire switch connection, wherein the first wire 42 and second wire 43 are disposed on same side of a standard light switch 18, i.e., on one side of the switch orifice 6; or a three wire switch connection, wherein first wire 42 and second wire 43 are disposed on opposite sides of the light switch 18, i.e., on opposite sides of the switch orifice 6 (as depicted in FIG. 7). Accordingly, the wire dressing for the two wire switch connection is different from the three wire switch connection. Due to the availability of the illuminated electrical light switch cover plate system 100 in two different wire switch connection designs, i.e., two wire switch connection and the three wire switch connection, the invention avoids the need for two products and eliminates the buyer's confusion to make the correct purchase.

The first wire 42 and second wire 43 may be designed to provide a stranded portion 54 secured by insulating sleeve 56 to a copper stud end portion 58. This allows connection to be made either to a screw terminal contact or to a push-pop clamp contact as found on most modern standard wire switches.

Figure 9:
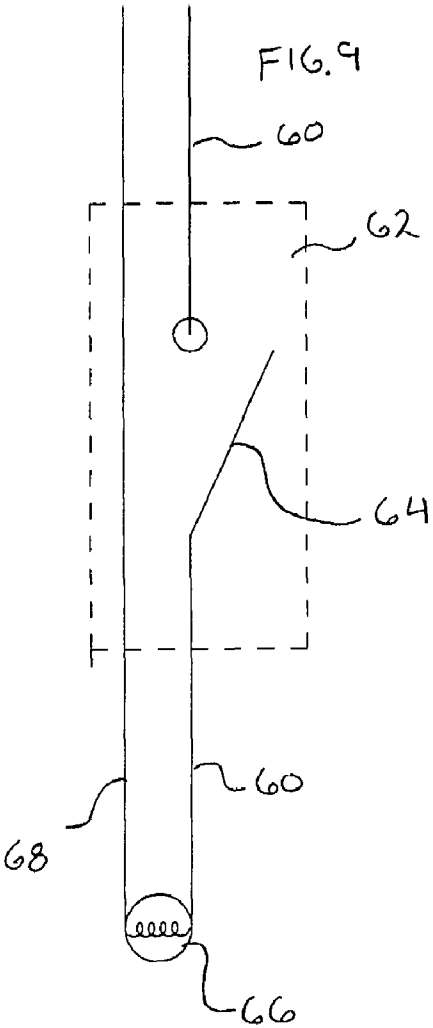
FIG. 9 is a diagrammatic representation of a conventional light switch circuit.

The installation and operation of the system 100 is best explained as follows with reference to FIGS. 9, 10 and 11. FIG. 9 represents a conventional electrical light switch system wherein electrical power provided by hot wire 60 flows into switch assembly 62 and depending upon the position of the switch toggle 64 either is allowed to continue along hot wire 60 across the resistive load light 66 to neutral wire 68, therein completing the circuit and illuminating the light 66. When the switch toggle 64 is positioned "OFF" there is no continuity along hot wire 60, and there is an open circuit situation wherein the light 66 is not illuminated as is the situation depicted in FIG. 9.

Figure 11:
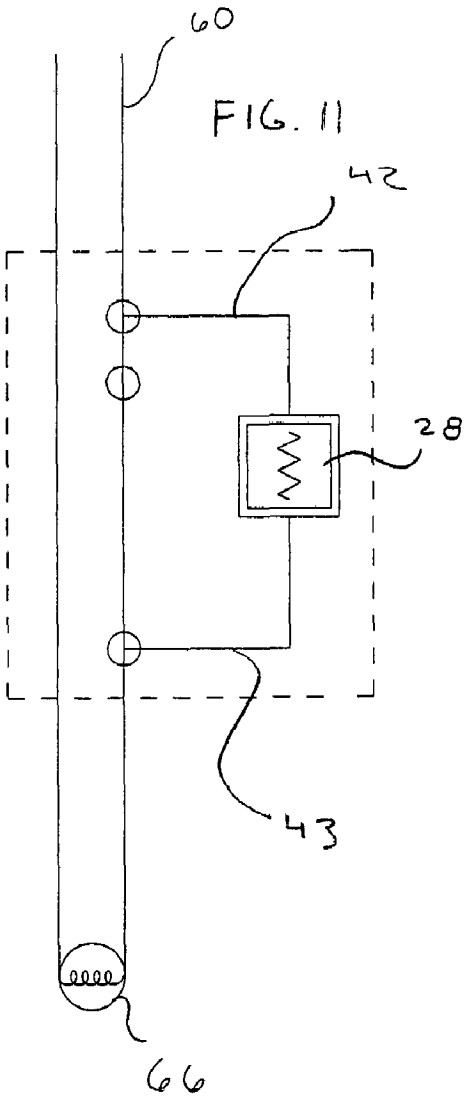
FIG. 11 is a diagrammatic representation of an deenergized illuminated electrical switch cover plate.
Figure 10:
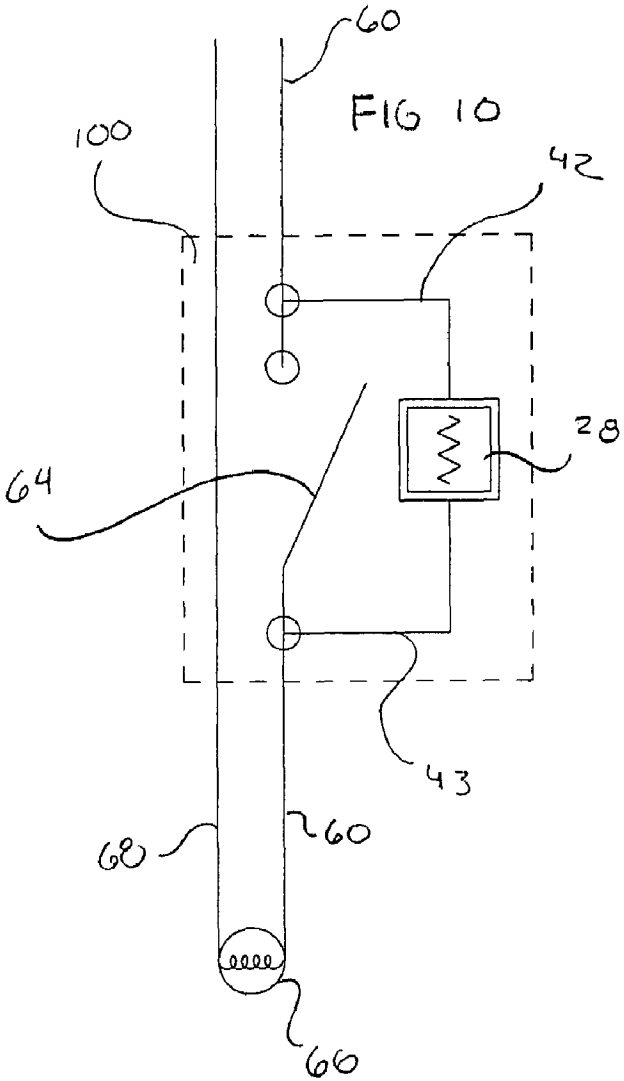
FIG. 10 is a diagrammatic representation of an energized illuminated electrical switch cover plate.

FIGS. 10 and 11 depict the illuminated electrical light switch cover plate system 100 installed in parallel around switch toggle 64. First wire 42 is connected to hot wire 60 before (upstream of) switch toggle 64, and second wire 43 is connected to hot wire 60 after (downstream of) switch toggle 64. In this fashion, when the switch toggle 64 is positioned to "OFF" (FIG. 10), there is not an open circuit situation and the electrical current flows through the PCB 28 and powers the LEDS 48 such that light is captured in the diffuser 30 and is dissipated though the lens 32 to illuminate an area around the switch. The current flowing through the PCB 28 returns to hot wire 60 and across the resistive load light 66 to neutral wire 68, therein completing the circuit, however because of the massive resistance imposed by the arrangement of electrical components on the PCB 28, the amount of power passing through the light 66 is limited to 1 watt. This is not enough power to illuminate the light 66 but is enough to raise the light's temperature above ambient. This is enough to reduce the temperature differential a fluorescent light experiences when first starting, so as to enhance the life of the light as discussed above.

Referring now to FIG. 11, When the switch toggle 64 is positioned "ON" the current takes the path of least resistance and sensing the huge resistive load across the PCB 28, does not travel along first wire 42 to the PCB 28, but rather continues along hot wire 60 in the identical fashion as described with the conventional electrical light switch system. The LEDS 48 do not illuminate.

Figure 12:
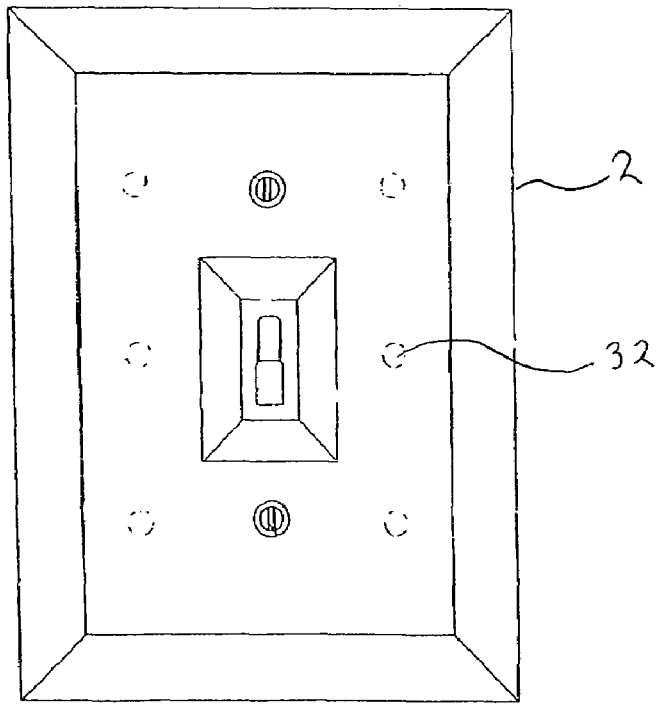
FIG. 12 is front view of the illuminated electrical switch cover plate showing the location of the light emitting diodes.

FIG. 12 shows a front view of the cover plate 2 showing (in broken line form) the location of the lenses 32 on the back of the cover plate 2.

Figure 13:
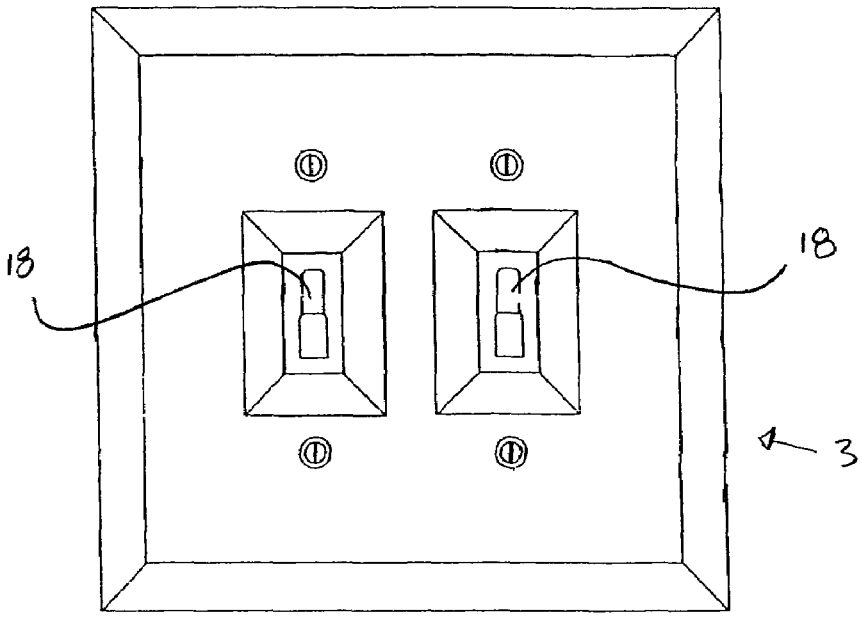
FIG. 13 is a front view of an alternate embodiment illuminated electrical switch cover plate.
Figure 14:
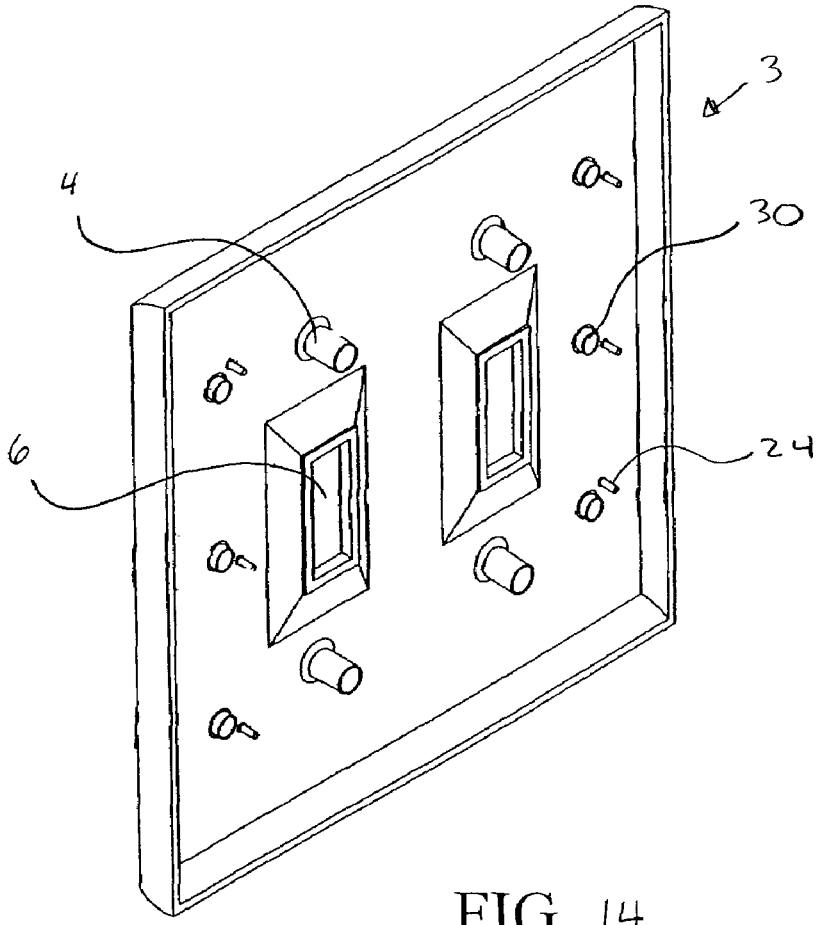
FIG. 14 is rear view of an alternate embodiment illuminated electrical switch cover plate.

FIGS. 13 and 14 show the front side and rear side of an alternate embodiment cover plate 3. This differs from the preferred embodiment cover plate 2 in that it is physically dimensioned to accept two light switches 18. The PCB utilized with this alternate embodiment cover plate 3 is substantially similar to the PCB 28 discussed herein except it's physical dimensions have been adjusted to matingly conform to that of the alternate embodiment cover plate 3. The type of structural changes required to build an illuminated electrical light switch cover plate system to accommodate multiple light switches 18 "ganged together" would be well known in the art.

Figure 15:
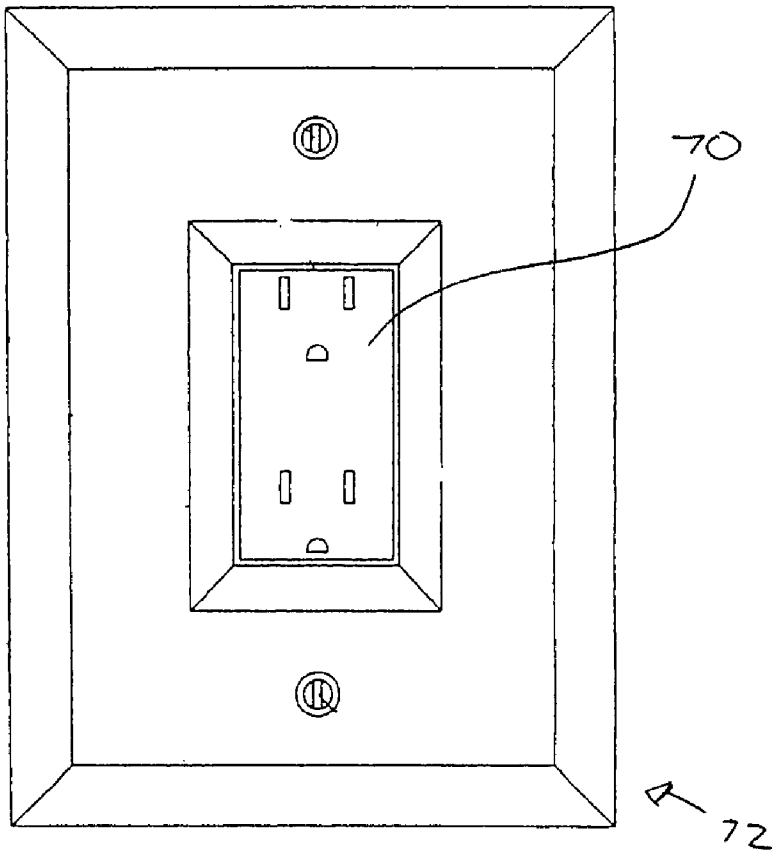
FIG. 15 is a front view of an alternate embodiment illuminated electrical outlet cover plate.

FIG. 15 illustrates a second alternate embodiment of the present invention illuminated electrical box cover plate 72, but for an electrical outlet 70. The type of structural changes required to be made to the cover plate portion to build the second alternate embodiment would be well known in the art.

The construction of the diffuser 30 and the lens 32 is adapted to create a uniformly glowing bright cover plate 2 that does not have any "ghosting" issues wherein the intensity of the LEDS allows shadows of the structures on the rear of the cover plate 2 to show through to the front, or wherein the light emitted from the LED can be seen as a point source from the front of the cover plate 2. The divergence of the light emitted from the LED 48 in the diffuser 30 is affected by the thickness of the cover plate 2, the amount of pigment in the cover plate 2, the contour of the lens 32 and the optical properties of the material the cover plate is fabricated from. In the preferred embodiment this is accomplished by a reduction of approximately 63%-75% of the normal pigment level for a conventional polymer light switch cover; the use of a concave "domed" lens design; a thin wall lens (0.025-0.030 inch). Experimentation has shown that with these configurations of the structural elements, ghosting does not occur and an aesthetically appealing level of illumination is uniformly distributed about the cover plate 2.

The system 100 has been shown to be retrofittable with a standard switch (FIG. 1), a multiple ganged switch (FIG. 13), or an electrical outlet (FIG. 15) although this is not an exhaustive list and is fully applicable to a decor or paddle or rocker switch. A wall plate may comprise any design capable of retrofitting with a standard switch configuration and capable of accommodating the LEDs 48 for illuminating the adjacent area. Depending upon the application, the cover plate configuration and dimensions vary.

The lens design enhances light direction and the diffusion of light, making light less direct and more pleasant. Also, in the present lens configuration design, the lenses 32 are integral with the cover plate 2 so that they do not protrude out of the front surface thereby reducing the ridges and aberrations on cover plate 2.

The lens assemblies 32 are disposed on two sides of the switch orifice 6 in sets of three lenses, although other configurations are possible provided they generate sufficient illumination.

The cover plate 2 may be made of any material providing sufficient structural integrity to enable the system 100 to be suitably installed on a wall, while being retrofittable with a switch on the wall. Suitable materials include, but are not limited to, thermoformed plastics, such as, polyolefins, polyesters, polybutylene terephthalate, acrylonitrile butadiene styrene (ABS), and the like. Various processes may be employed to custom design the wall plate. Suitable processes include, but are not limited to, injection molding, extrusion molding, blow molding, vacuum forming, compression molding, and the like.

While the PCB 28 may be engaged to the back surface of the cover plate 22, using heat staking, the PCB 28 may have engagement features removably engaging with complementary engagement features on the back surface of the cover plate 22.

The LEDs 170 may be of a single or multiple colors, such as, red, green, blue, white, orange, yellow, and the like. RGB multi-color LEDs may also be used along with a color shifting and patterning microprocessor.

Optionally, the system 100 may further comprise an on/off switch (not shown) for powering on/off the LEDs 48 or an illumination adjustment switch. It is also well known in the art that the selection, quantity and properties/characteristics of the LED's 48 and electrical components present of the PCB may be adjusted to accommodate more or less illumination, however the power output of the PCB will remain at 1 watt + or −1 watt.

The preferred embodiment has a 1 watt power profile although higher or lower power profiles to accommodate different levels of illumination or heat dissipation to protect the PCB and maintain a cool surface temperature on the cover plate, can easily be accomplished by the addition/removal of resistors and LEDs.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Having thus described the invention, what is claimed as new and desired to be secured by Letters Patent is as follows:

1. A low level illumination system comprising:

a switch cover plate adapted for housing an electrical light switch having at least one lens formed by a blind ended orifice formed on a back surface thereof said switch cover plate;

a chamber formed about a periphery of said orifice extending from said back surface;

a means for providing a bypass electrical bleed current comprising a U shaped printed circuit board having at least having at least four light emitting diodes, eight resistors, four 0.01 to 0.1 μF capacitors, a 1 amp/400 watt diode and a plurality of interface wires disposed thereon so as to form an array of electrically connected components that has a one watt power profile in parallel electrical configuration with said electrical light switch with at least one light emitting diode affixed to a face thereof said means;

at least two wires forming an electrical connection between the low level illumination system and a light switch power supply;

wherein said means for providing a bypass electrical bleed current is engaged with said back surface such that said LED is positioned adjacent said chamber such that at least a portion of light emitted from said light emitting diode is received within said chamber and dispersed through said lens to illuminate an area on and around said switch cover plate.

2. The low level illumination system of claim 1 wherein said blind end has a concave configuration.

3. The low level illumination system of claim 2 wherein said bypass electrical bleed current preheats any fluorescent lights fed from said light switch.

4. The low level illumination system of claim 3 further comprising at least one positioning post extending normally from said back surface of said light switch cover.

5. The low level illumination system of claim 4 wherein said means for providing a bypass electrical bleed current has at least one aperture therethrough matingly conformed to engage said positioning post so as to align said means for providing a bypass electrical bleed current with said cover plate such that said LED is positioned therein said chamber.

6. The low level illumination system of claim 1, wherein four LEDs are positioned adjacent four chambers disposed in two parallel and congruent rows of two LEDS on said light switch cover plate.

7. The low level illumination system of claim 1, wherein six LEDs are positioned adjacent six chambers disposed in two parallel and congruent rows of three LEDS on said light switch cover plate.

8. The low level illumination system of claim 5, wherein the means for providing a bypass electrical bleed current is engaged to the back surface of the cover plate using heat staking with the positioning posts.

9. The low level illumination system of claim 1, wherein the means for providing a bypass electrical bleed current further comprises a plurality of series installed resistors capable of reducing hot spots and removing heat evenly from the means for providing a bypass electrical bleed current.

10. The low level illumination system of claim 9, wherein the means for providing a bypass electrical bleed current further comprises a parallel installed capacitor placed across the light emitting diode for protecting the light emitting diode from electro static discharge.

11. The low level illumination system of claim 10, wherein the means for providing a bypass electrical bleed current further comprises a series connected diode.

12. A low level illumination system comprising:

an electrical outlet cover plate for partially receiving and housing an electrical power outlet having at least one lens formed by a blind ended orifice formed on a back surface thereof;

a chamber formed about a periphery of said orifice extending from said back surface;

a means for providing a bypass electrical bleed current to any electrical device connected to said electrical outlet having at least one light emitting diode affixed thereto and mechanically connected to said back surface;

said means for providing a bypass electrical bleed current comprising a U shaped printed circuit board having at least having at least four light emitting diodes, eight resistors, four 0.01 to 0.1μF capacitors, a 1 amp/400 watt diode and a plurality of interface wires disposed thereon so as to form an array of electrically connected components that has a one watt power profile;

at least two wires forming an electrical connection between the low level illumination system and a power supply;

wherein said means for providing a bypass electrical bleed current is engaged with said back surface such that said LED is positioned adjacent said chamber such that at least a portion of light emitted from said light emitting diode is received within said chamber and dispersed through said lens to illuminate an area on and around the outlet cover plate.

13. The low level illumination system of claim 12 wherein said blind end has a concave configuration.

14. The low level illumination system of claim 13 wherein said connection is a parallel electrical connection with an said electrical power outlet.

15. The low level illumination system of claim 14 further comprising at least one positioning post extending normally from said back surface of said outlet cover plate.

16. The low level illumination system of claim 15 wherein said means for providing a bypass electrical bleed current has at least one aperture therethrough matingly conformed to engage said positioning post so as to align said means for providing a bypass electrical bleed current with said cover plate such that said LED is positioned therein said chamber.

17. The low level illumination system of claim 12, wherein six LEDs are positioned adjacent six chambers disposed in two parallel and congruent rows of three LEDS on said electrical outlet cover plate.

18. The low level illumination system of claim 17 wherein the means for providing a bypass electrical bleed current is engaged to the back surface of the cover plate using heat staking with the positioning posts.

* * * * *